US005464224A

United States Patent [19]

Rosenbaum

[11] Patent Number: 5,464,224

[45] Date of Patent: Nov. 7, 1995

[54] BOARD GAME APPARATUS AND METHOD OF PLAY

[76] Inventor: David A. Rosenbaum, 931 McKee St., State College, Pa. 16803

[21] Appl. No.: 317,337

[22] Filed: Oct. 4, 1994

[51] Int. Cl.[6] ..... A63F 3/00

[52] U.S. Cl. ..... 273/258; 273/282.1

[58] Field of Search ..... 273/267, 248, 273/249, 258, 282.1, 288

[56] References Cited

U.S. PATENT DOCUMENTS

| | | | |
|---|---|---|---|
| 1,666,359 | 4/1928 | Steves | 273/267 |
| 2,187,808 | 1/1940 | Parker | 273/258 |
| 3,025,063 | 3/1962 | Magee | 273/249 |
| 3,473,809 | 10/1969 | Day | 273/243 |
| 3,850,433 | 11/1974 | Purlia | 273/256 |
| 3,885,792 | 5/1975 | Breslow | 273/256 |
| 4,244,581 | 1/1981 | Imatt | 273/282 |
| 4,288,079 | 9/1981 | Belony | 273/273 |
| 4,834,388 | 5/1989 | Dorel et al. | 273/236 |
| 4,936,585 | 6/1990 | Looney et al. | 273/236 |
| 5,064,200 | 11/1991 | Martinez | 273/243 |
| 5,190,292 | 3/1993 | Perry | 273/256 |

FOREIGN PATENT DOCUMENTS

| | | | |
|---|---|---|---|
| 12750 | of 1894 | United Kingdom | 273/267 |

*Primary Examiner*—Benjamin H. Layno
*Attorney, Agent, or Firm*—Sofer & Haroun

[57] ABSTRACT

A game board includes a field defining an m by n array of playing spaces arranged in rows and columns on the field and a plurality of edge regions, wherein each edge region is disposed between a corresponding pair of adjacent playing spaces and wherein visually distinguishable first and second home positions are defined by two of the playing spaces. The game board further includes first and second visually distinguishable playing pieces and first and second sets of fence pieces. The fence pieces of the first set are visually distinguishable from fence pieces of the second set. The fences are stored in a bag from which they are randomly withdrawn during the game.

18 Claims, 3 Drawing Sheets

BOARD GAME APPARATUS AND METHOD OF PLAY

FIELD OF THE INVENTION

The present invention relates to a strategic board game played by two participants, and more particularly, to a method of manipulating a plurality of playing pieces on a board to create a dynamic maze environment.

BACKGROUND OF THE INVENTION

Many two-player board games utilize an orthogonal array of playing spaces. Board games of this type, such as chess or checkers, have several carefully defined features. Typically, each player has a turn, in which they make their move(s) as outlined by the rules. The players take their turns in alternating style and the manner in which the playing pieces are placed on the board is regulated by markings on the board as well as by the rules of the game themselves.

These prior art games do not utilize a scheme or method of play whereby the placement of playing pieces is defined with reference to the positions of movable blocking pieces between adjacent playing spaces.

SUMMARY OF THE INVENTION

A game board constructed in accordance with the present invention includes a field defining an m by n array of playing spaces arranged in rows and columns on the field and a plurality of edge regions, wherein each edge region is disposed between a corresponding pair of adjacent playing spaces and wherein visually distinguishable first and second home positions are defined by two of the playing spaces. The game board further includes first and second visually distinguishable playing pieces and first and second sets of fence pieces. The fence pieces of the first set are visually distinguishable from fence pieces of the second set. Illustratively, the first and second playing pieces are color coded to correspond with said first and second home positions. Preferably, the fences are stored in a bag from which they may be randomly and individually withdrawn during play.

In accordance with an illustrative embodiment of a game apparatus constructed in accordance with the present invention, the m x n array of playing spaces comprises an equal number of rows and columns. The edge regions between the playing spaces preferably comprise visually distinguishable horizontal and vertical edge regions which visually correspond, as by color coding or other means, to the first and second sets of fence pieces, respectively.

In accordance with a presently preferred embodiment of the present invention, each of the fence pieces dimensionally corresponds ill length to one of the edge regions so that when the fence pieces are placed between adjacent playing spaces, only one edge region is covered. It should, however, be noted that the length of the fence pieces may be varied to correspond to any number of playing spaces if it is desired to block movement between additional adjacent pairs thereof. The fence pieces may also have one or more corners, making it possible to block movement between pairs of spaces that are not colinear.

A method of playing a board game constructed in accordance with the present invention includes providing a game board having a field defining an m by n array of playing spaces arranged in rows and columns on the field, the game board defining an edge region between each pair of adjacent playing spaces and the array including first and second home regions visually distinguishable from one another and from remaining playing spaces. The method further includes providing a playing piece for each player, the playing pieces being visually distinguishable from one another and providing a group of first and second sets of fence pieces, fence pieces of the first set being visually distinguishable from fence pieces of the second set. The playing pieces and/or fence pieces may have tactile cues thus making the game playable by visually impaired persons as well as by sighted people.

The method further includes randomly selecting at least one fence piece from the group, positioning the selected fence piece on an edge region, and manipulating the playing pieces in alternating turns such that each player may move a corresponding playing piece in a horizontal or vertical direction from a corresponding playing space to an adjacent playing space unless a fence piece is interposed therebetween.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
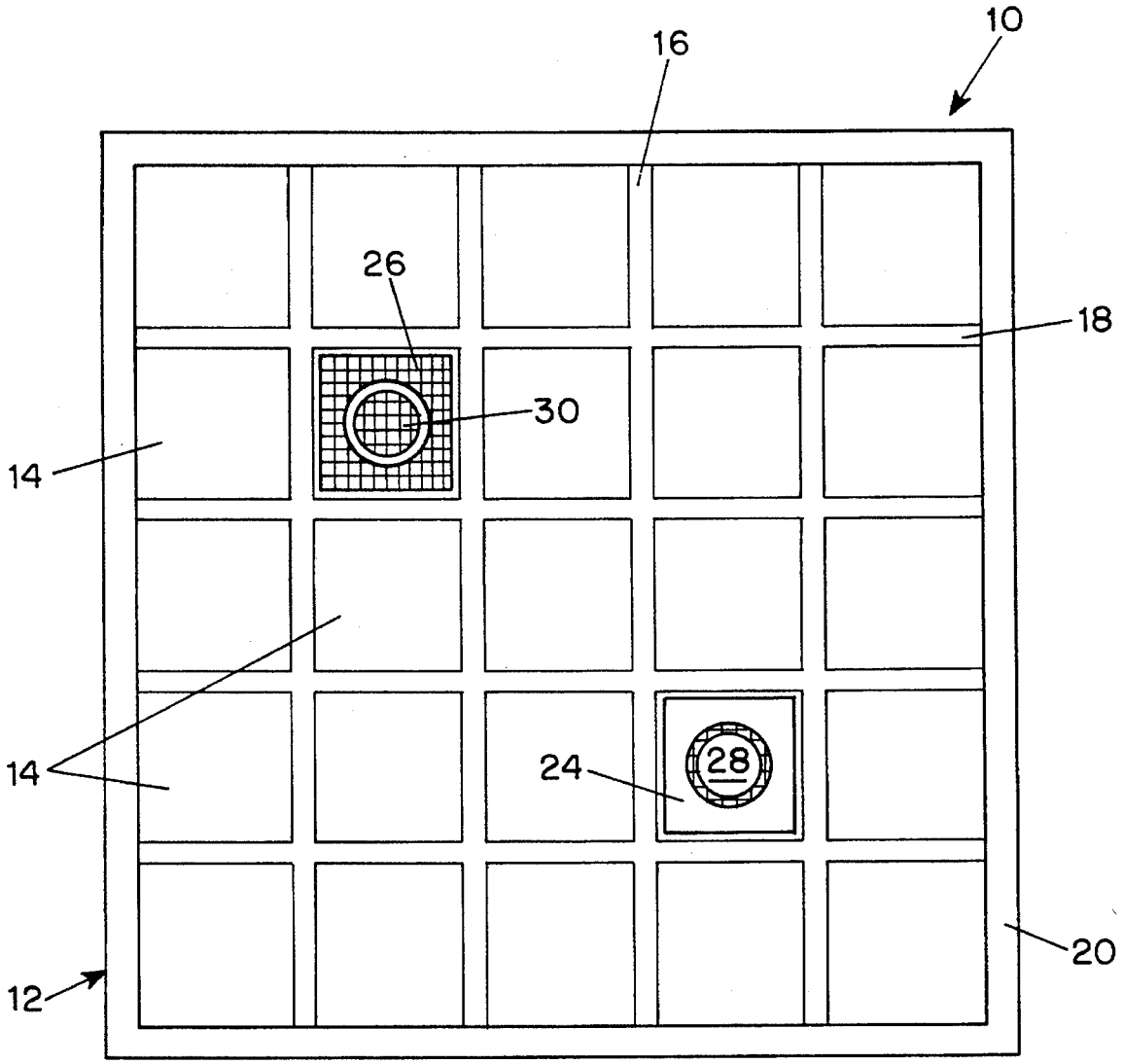
FIG. 1 is a plan view of a game board made in accordance with the concepts of the present invention.

A game apparatus 10 constructed in accordance with an illustrative embodiment of the present invention is shown in FIG. 1. The game apparatus includes a playing board 12 having a plurality of playing spaces 14 each generally square in shape and arranged in rows and columns. These playing spaces are separated from each other on all sides by vertical and horizontally oriented edge regions 16 and 18, respectively. In the illustrative embodiment depicted in FIG. 1, edge regions 16 and 18 are coplanar with playing spaces 14. However, if desired, edge regions 16 and 18 may also be configured as grooves or slits in the playing board 12.

In the illustrative embodiment depicted in FIG. 1, playing spaces 14 are arranged in an m×n array in which m and n are each equal to five. It will, of course, be understood that the number of rows and columns need not be the same and that additional or fewer rows and columns may be added without departing from the spirit and scope of the present invention. In any event, it will be observed that the outer perimeter of the playing board 12 has a perimeter region 20 which can be color coded or provided with some other indicia. However, as presently preferred, this perimeter region is the same neutral color as the playing spaces 14.

One of the playing spaces 14 is designated a "home position" space by corresponding color coding or indicia. In the illustrative embodiment of FIG. 1, home position spaces 24 and 26, are colored white and black, respectively. First and second player pieces 28 and 30, which are color coded to correspond to home positions 24 and 26, respectively, are shown in their initial positions prior to the start of the game.

Figure 2:
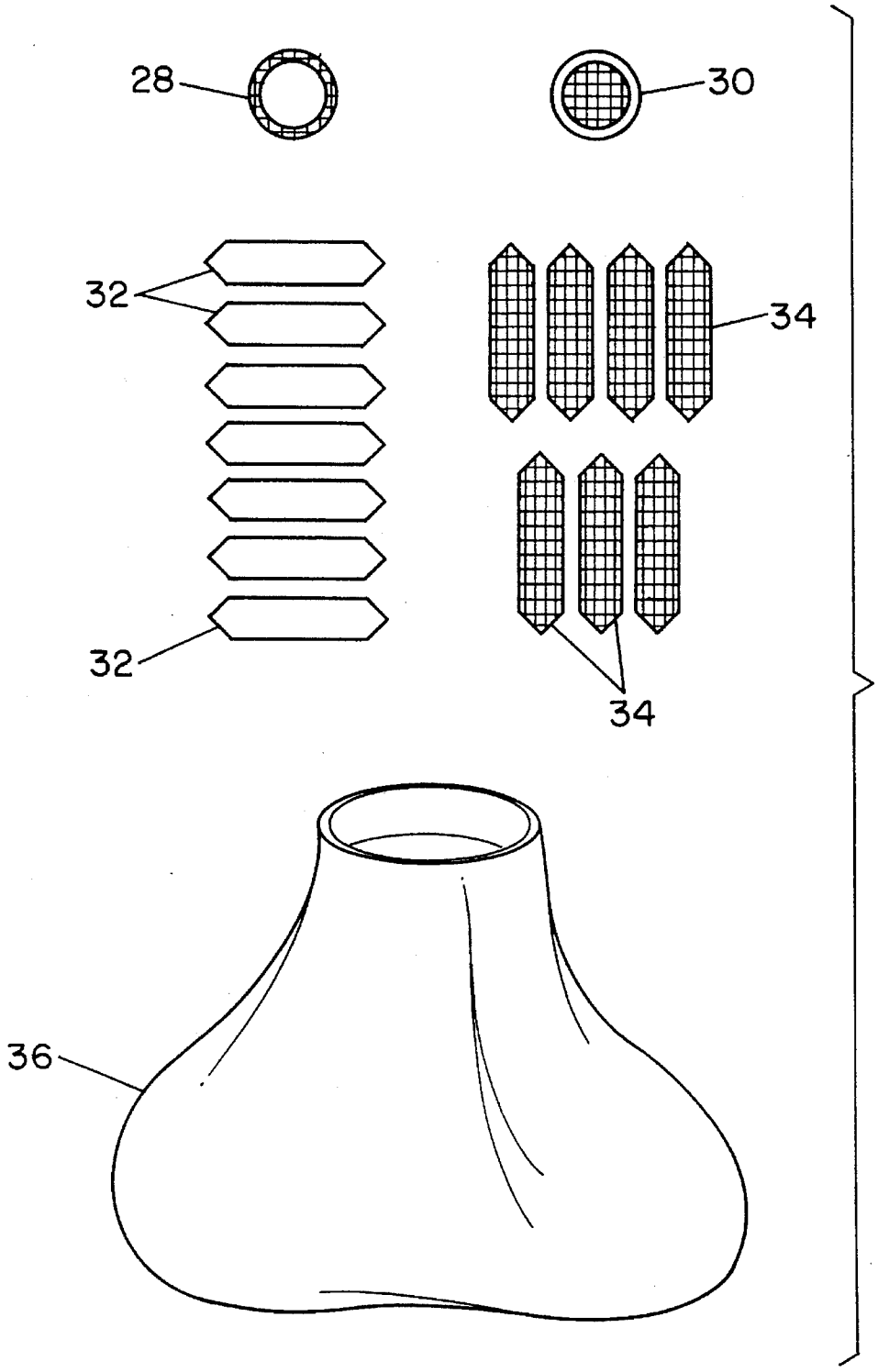
FIG. 2 is a plan view depicting the playing pieces utilized with the game board of FIG. 1 in accordance with the present invention.

With reference now to FIG. 2, it will be seen that in addition to color coded player pieces 28 and 30, the game apparatus 10 further includes two sets of fence or barrier playing pieces, with the fence piece of each corresponding set being designated individually by the reference numerals 32 or 34, respectively. Essentially, fence pieces 32 and 34 are configured as relatively fiat elongated structures which are dimensioned for positioning over only one of the edge regions 16 or 18 between two adjacent playing spaces. Preferably, the fence pieces are fabricated from plastic, wood, or some other durable material. For a purpose which will soon be described, the sets of fence pieces 32 and 34 are distinguishable from each other by means of differential coloring, shape, markings, or similar means. A storage bag or other open-ended enclosure, from which individual fence pieces 32 and 34 may be randomly withdrawn during play, is indicated generally at 36.

The present invention includes a method of playing the game with the above-described apparatus. FIG. 1 depicts the respective positions of first and second playing pieces 28 and 30 on their home position playing spaces at the start of the game. Each player is assigned one of playing pieces 28 or 30. The goal of the first playing piece 28 is home position 26 and the goal of the second playing piece 30 is home position 24.

Figure 3:
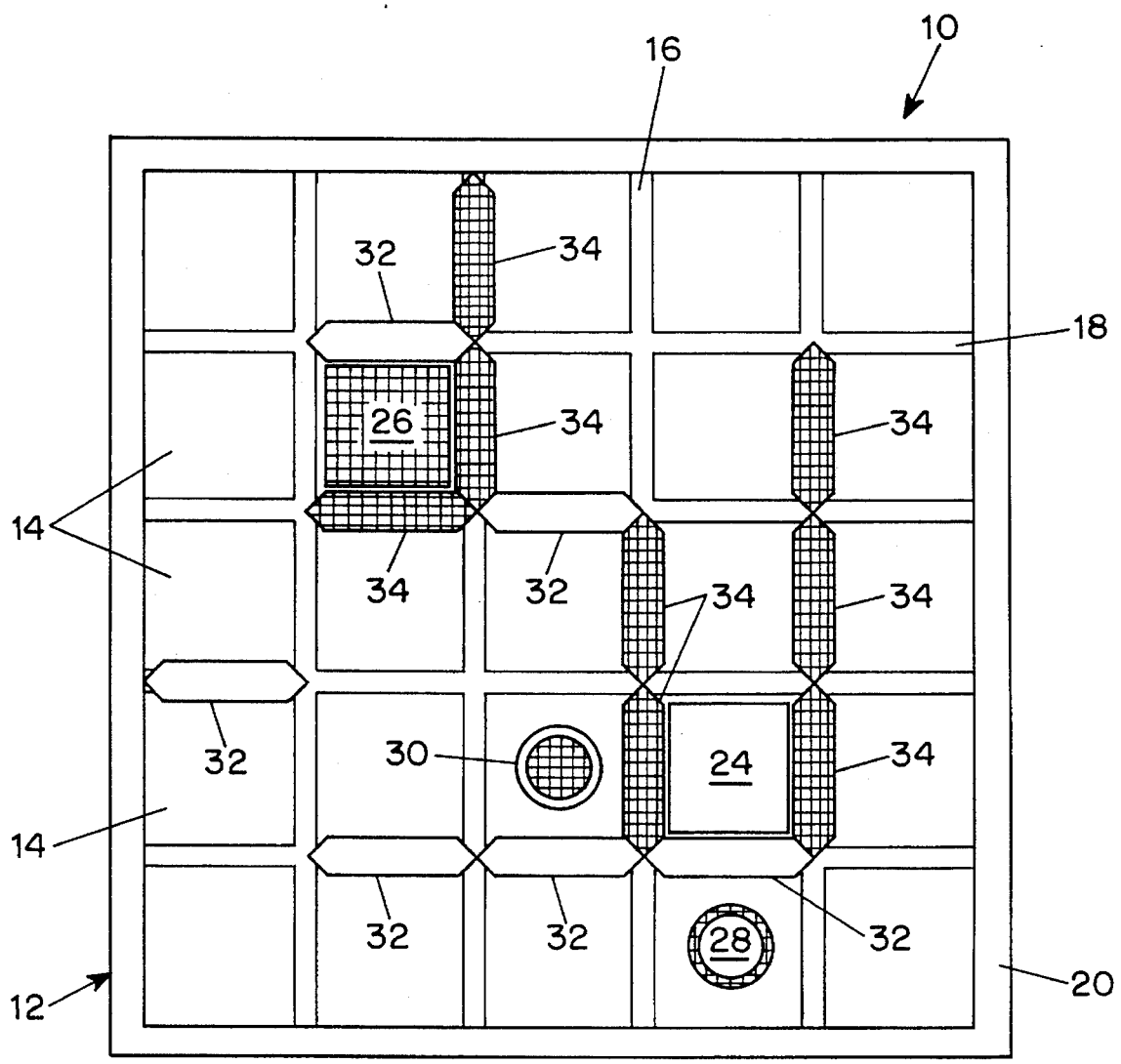
FIG. 3 is a plan view depicting the positions and orientation of various playing pieces on the game board during play.

Play in accordance with the method of the present invention commences with the placement by one player of his or her playing piece upon an adjacent "playable" space 14 on board 12, as shown in FIG. 3. A second portion of the player's turn comprises the steps of withdrawing one fence piece 32 or 34 from bag 36 and positioning it on one edge region of game board 12. The other player then takes his or her turn by repeating the aforementioned steps, and turns are alternated in this fashion, until there are no fence pieces remaining in the bag.

A playing piece must be moved horizontally or vertically, but never diagonally, to an adjacent playable space. An open or "playable" space is defined as one which is not occupied by the other playing piece and not blocked. Movement from one playable space to another is blocked, for example, when a fence piece 32 or 34 is positioned in the edge region between them. A playing piece can never be moved back to its home position. Additionally, a playing piece can never be moved to a playing space that is vertically or horizontally adjacent to a playing space occupied by the other playing piece, unless there is a fence piece between the two playing spaces. Moreover, a playing piece can never be moved to a playing space that is diagonally adjacent to a playing space occupied by the other playing piece, unless a fence piece touches the corner shared by the diagonally adjacent playing spaces. A player can not place a fence piece on an edge region which would prevent the opponent from moving at all. Moreover, a player cannot place a fence piece on an edge region which would prevent either playing piece from reaching its goal through at least one combination of legal moves, with one exception. Specifically, if the path from the opponent's piece to its goal is only momentarily blocked by the player's own piece, that player may place the fence piece on an edge region that blocks the opponent's path.

Removal of the fence pieces 32 and 34 from the bag and their placement on board 12 will now be described in detail. At the beginning of the game, bag 36 contains all fence pieces 32 and 34. So long as there is at least one fence piece in bag 36, and at no prior time has the bag been emptied, the player whose turn it is must move his or her playing piece and remove a fence from the bag at random. If a fence 32 from the first set is removed from bag 36, the player must place it on any unoccupied vertical edge region 16. If a fence 34 from the second set is removed from bag 36, the player must place it on any unoccupied, horizontal edge region 18.

Once all of the fence pieces 32 and 34 have been placed on the game board 12, the players continue to begin their turn by moving their playing pieces in the manner discussed above. However, the second portion of each player's turn now includes two options. If there is a fence on the edge of one of the playing spaces in the middle row of the board, a player can pick up that fence and move it to any other unoccupied edge region having the same orientation (i.e. horizontal or vertical) during his or her turn. If a fence piece is on the edge of any playing space in the row above the opponent's home position, on the edge of any playing space in the row containing the opponent's home position, or on the edge of any playing space in the row below the opponent's home position, a player can remove that fence piece from the game board and return it to the fence bag 36. Both players must wait until all fence pieces 32 and 34 have been returned to the fence bag before any fence piece can be removed from fence bag 36 and returned to the board. Once any fence piece has been removed from the fence bag for the second time, no fence piece can be returned to the fence bag until all fence pieces have been removed from the fence bag. As the game continues, it is always necessary to fully empty the fence bag before any fences can be returned to the fence bag, and it is necessary to return all fences to the fence bag before any fences can be removed from the fence bag.

The first player to bring his or her playing piece to the opponent's home position wins the game, with one exception. Specifically, the game ends in a draw if the first player to reach the opposing player's home position had the first turn and the opposing player can bring his or her playing piece to the first player's home position in the next turn.

While there have been shown and described fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A method of playing a board game of skill and strategy comprising the steps of:

(a) providing a game board having a field defining an m by n array of playing spaces arranged in rows and columns on the field, said game board defining an edge region between each pair of adjacent playing spaces and said array including first and second home regions visually distinguishable from one another and from remaining playing spaces;

(b) providing a playing piece for each player, said playing pieces being visually distinguishable from one another;

(c) providing a group of first and second sets of fence pieces, fence pieces of said first set being visually distinguishable from fence pieces of said second set;

(d) randomly selecting at least one fence piece from said group and positioning the selected fence piece on an edge region; and (e) manipulating said playing pieces in alternating turns such that each player may move a corresponding playing piece in a horizontal or vertical direction from a corresponding playing space to an adjacent playing space unless a fence piece is interposed therebetween.

2. The method according to claim 1, wherein said selecting step comprises removing said at least one fence piece from a bag during one of said alternating turns.

3. The method according to claim 2, wherein a fence piece is removed during each of said alternating turns until all of said fence pieces have been placed on said game board.

4. The method according to claim 1, wherein said fence piece positioning step includes one of placing a fence piece from said first set on a horizontally oriented edge region and placing a fence piece from said second set on a vertically oriented edge region, thereby blocking horizontal or vertical movement between a corresponding pair of adjacent playing spaces.

5. The method according to claim 4, wherein a fence piece is placed on an edge region during each of said alternating turns until all of said fence pieces have been placed on said game board.

6. The method according to claim 5, further including one of moving a fence piece on said game board to an unoccupied edge region and removing a fence piece from said game board, during each alternating turn, once all of said fence pieces have been placed thereon.

7. The method according to claim 1, wherein said playing pieces are moved during said manipulating step until a playing piece is moved onto a corresponding home position.

8. A game apparatus, comprising:

a game board having a field defining an m by n array of playing spaces arranged in rows and columns on the field and a plurality of edge regions, wherein each region is disposed between a corresponding pair of adjacent playing spaces and wherein visually distinguishable first and second home positions are defined by two of said playing spaces;

first and second playing pieces, said first and second playing pieces being visually distinguishable from one another;

first and second sets of fence pieces, fence pieces of said first set being visually distinguishable from fence pieces of said second set; and means for randomly selecting individual fence pieces.

9. The game apparatus of claim 8, wherein said m×n array comprises an equal number of rows and columns.

10. The game apparatus of claim 9, wherein said m×n array comprises five rows and five columns.

11. The game apparatus of claim 8, wherein said first and second playing pieces are color coded to correspond with said first and second home positions.

12. The game apparatus of claim 8, wherein said first and second sets of fence pieces are color coded.

13. The game apparatus of claim 8, wherein said edge regions comprise visually distinguishable horizontal and vertical edge regions.

14. The game apparatus of claim 13, wherein said horizontal edge regions and said vertical edge regions visually correspond to said first and second sets of fence pieces, respectively.

15. The game apparatus of claim 14, wherein said horizontal edge regions and said vertical edge regions are color coded to correspond to said first and second sets of fence pieces, respectively.

16. The game apparatus of claim 8, wherein said means for randomly selecting individual fence pieces comprises an open ended bag for retaining said fence pieces.

17. The game apparatus of claim 8, wherein each of said fence pieces dimensionally corresponds in length to one of said edge regions.

18. The game apparatus of claim 8, wherein said edge regions are defined by slits in said game board and said fence pieces are dimensioned and arranged for insertion into said slits to ensure upright orientation on said game board.

* * * * *